United States Patent [19]

Durand et al.

[11] 4,437,792

[45] Mar. 20, 1984

[54] VERTICALLY MOVING PLATFORM SUPPORTED ON LEGS

[75] Inventors: François Durand, Antibes, France; Auguste Smulders, Geneva, Switzerland

[73] Assignee: Societe Anonyme Engrenages et Reducteurs, Velizy Villacoublay, France; a part interest

[21] Appl. No.: 292,695

[22] Filed: Aug. 13, 1981

[30] Foreign Application Priority Data

Oct. 13, 1980 [FR] France ..... 80 21804

[51] Int. Cl.[3] ..... E21B 7/12

[52] U.S. Cl. ..... 405/198; 74/421 R; 254/97; 254/112; 405/196

[58] Field of Search ..... 405/196–199, 405/203, 204, 207, 208; 254/105, 106, 107, 110, 112, 95, 97; 74/421 R, 422

[56] References Cited

U.S. PATENT DOCUMENTS 3,367,119 2/1968 Rybicki ..... 405/196
3,399,578 9/1968 Lindabury et al. ..... 74/422 X
3,570,032 3/1971 Allen ..... 405/199 X
3,965,757 6/1976 Barrus ..... 74/422 X
4,269,543 5/1981 Goldman et al. ..... 405/198

FOREIGN PATENT DOCUMENTS 7804236 11/1978 Netherlands ..... 405/198

*Primary Examiner*—Dennis L. Taylor
*Attorney, Agent, or Firm*—Young & Thompson

[57] ABSTRACT

A mobile platform with relatively vertically movable legs, of the off-shore drilling platform type, has a plurality of pairs of opposed racks on each leg, with a row of pinions supported in a pinion carrier for each rack. A link for each pinion carrier is pivoted at one end of the pinion carrier and at the other end to the platform and is disposed in the medial plane of the teeth of the double rack. On the opposite side of the leg from one of these double racks is provided structure for detachably interconnecting the lower end of the leg to the platform for vertical swinging movement of the leg when the leg is in raised position, about an axis parallel to that plane, so that the legs can be swung together at their upper ends when in raised position, into a pyramidal configuration.

2 Claims, 5 Drawing Figures

VERTICALLY MOVING PLATFORM SUPPORTED ON LEGS

The present invention relates to vertically movable platforms supported on legs, for example of the type of drilling platforms for performing off-shore drilling operations.

It is known to provide the legs of such platforms with pairs of racks opposed to each other, with pinions that engage with the double racks, whereby rotation of the pinions in engagement with the racks raises or lowers the platform. Such devices are shown for example in U.S. Pat. Nos. 2,308,743 and 3,398,541.

It is also known to provide the mounting of a pinion in a floating support connected to a fixed point by a link that is articulated at both ends to provide optimum contact between the pinion and the rack, with the link disposed substantially in the medial plane of the teeth, as shown for example in U.S. Pat. No. 3,176,533. It is known that the cost of construction of the legs and guides of such a platform can vary quite considerably as a function of the manufacturing tolerances: if the permissible tolerances are great, the cost is less; but it is then necessary to provide pinion carriers which are movably mounted relative to the platform, so as to follow the movements of the legs relative to the platform.

It is also to be considered, that, in the raised position of the platform, the effects of wind, waves and currents on the legs impose stresses in the legs whose magnitude increases along the legs in a direction from their ground-supported end to a maximum at the portion of the leg which is encased in the platform. The legs must therefore be designed and built not only to sustain the weight of the platform but more so to resist these flexure stresses due to wind, waves and currents, whose magnitude is at a maximum at the level of that portion of the leg that is within the platform.

On the other hand, during towing of the platform on the high seas, the legs will be raised and in a position perpendicular to the floor of the platform. Under these circumstances, that portion of the legs which is encased within the platform and which is subjected to the maximum stress, is situated at the lower end of the legs, which is the part that bears the least stress when the platform is raised and resting on its legs.

It is therefore an object of the present invention to provide a construction for the legs which will avoid the imposition of these high stresses in the lower portion of the legs during towing. According to the present invention, this is achieved by inclining the raised legs toward the center of the platform and interconnecting the upper ends of the raised legs so as to form a pyramid.

Another object of the present invention is to provide pinion carriers which will be self-aligning and automatically swinging for use with such legs. These pinion carriers are arranged in known manner to engage with double opposed rack bars which form a part of the structure of the leg and are characterized on the one hand by the fact that each row of pinions that meshes with one of the rack bars is connected to the platform by a link articulated at its two ends, namely two links per pinion carrier, one for each row of pinions, the axes of articulation of these links being substantially situated in the medial plane of the teeth of the pinions, these axes of articulation permitting the pinion carrier which controls the swinging of the leg to swing with the leg.

Guide blocks can be provided to assist in maintaining the pinion carriers parallel to their respective racks. These pinion carriers are characterized on the other hand by the fact that each pinion is driven by a planetary reducer whose casing is an integral part of the pinion carrier, each planetary reducer being driven by a motor reducer swingably mounted and connected to the pinion carrier, or to the cover of the planetary reducer, by a dynamometric shock absorber which permits one to control at all times the couple transmitted by the corresponding pinion and consequently to act on the motors or brakes, either manually or automatically.

The guiding within the platform being accomplished by blocks against which the ends of the rack teeth slide, a series of guides independent from the pinion carriers located above the pinion carriers and a series of guides located in the lower portion of the platform, this pinion carrier is also characterized by the fact that the guide blocks may be interposed between the links of the pinion carriers and the ends of the rack teeth, so as to serve as lower guides whilst, raising the lower ends of the legs to the level of the floor of the platform, the links leave the guides which are situated at the lower portion of the platform. When the foot of the leg is raised to the level of the floor of the platform, heavy pins are engaged in suitable recesses that are respectively fitted to the platform and to the foot of the leg, these pins together forming the swinging axis of the leg. This swinging axis is on the one hand parallel to one of the planes defined by one of the double rack bars of the leg and on the other hand correctly oriented with respect to the other legs to permit the legs to come together in a pyramid.

It is the pinion carrier associated with the double rack whose tooth plane is parallel to the swinging axis, which is used to effect the swinging of the leg. After having established the swinging axis, the articulated links of the pinion carriers whose tooth planes of their double racks are not parallel to the swinging axis are disconnected. The upper guides corresponding to the pinion carriers whose articulated links were disconnected, are also disconnected, which permits swinging of the legs toward the center of the platform whilst turning in the given direction the pinions of the pinion carrier associated with the double rack whose tooth plane is parallel to the swinging axis.

Other objects, features and advantages of the present invention will become apparent from a consideration of the following specification, taken in connection with the accompanying drawings, which show a triangular leg comprising three double racks. However, it is obvious that platform legs according to the present invention could have two, four, five or even six double racks. In the drawings:

FIG. 1 is a plan view of a corner of a leg, one corner being a view taken from above the upper guide, another corner of the leg being viewed in cross section in a plane between the upper side of the pinion carriers and the underside of the upper guides along the line I—I of FIG. 2, the third corner of the leg being shown in cross section on a plane passing through the upper articulation axis of the links which connect the pinion carriers to the platform, on the line II—II of FIG. 2;

Figure 1:
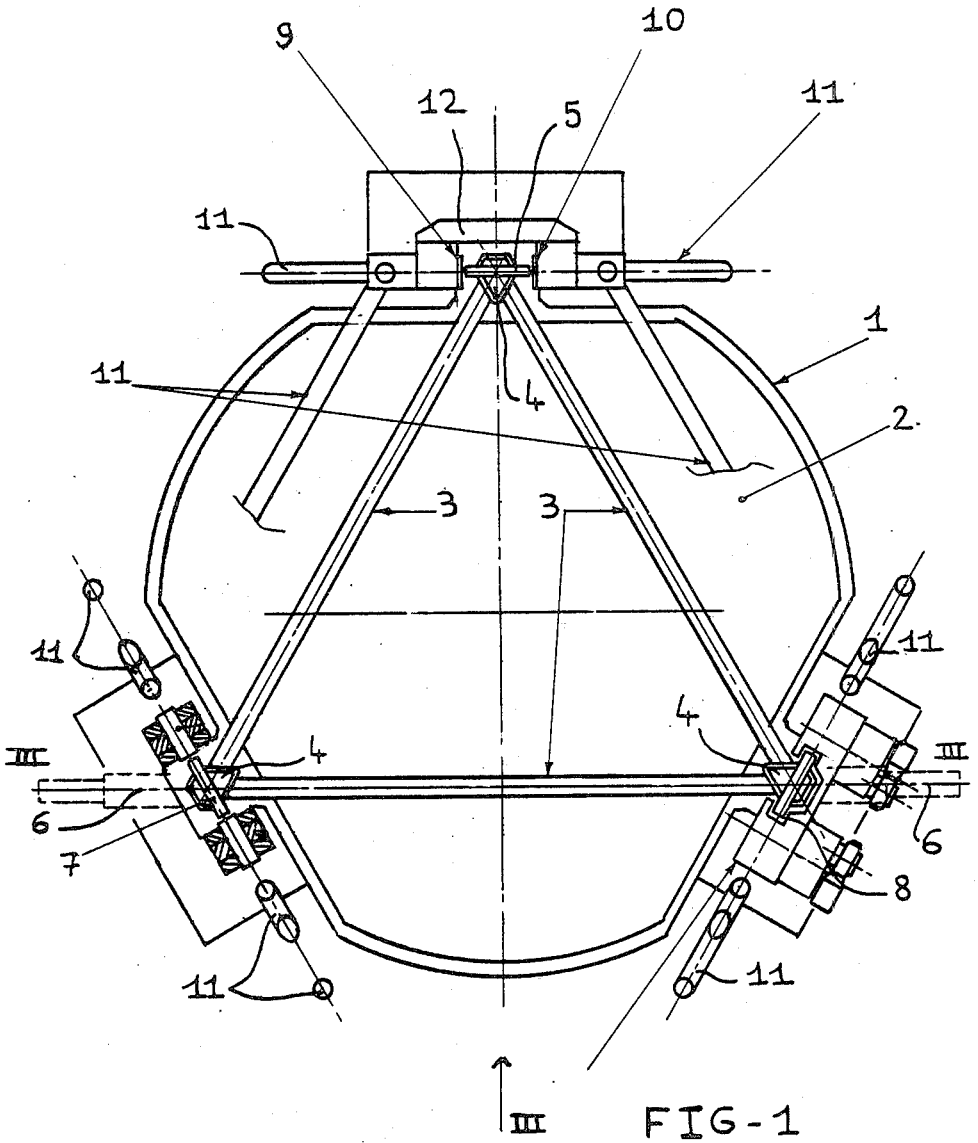

Referring now to the drawings in greater detail, and first to FIG. 1 thereof, there is shown a leg-supported platform according to the present invention, of the drilling rig type, in which there is provided a well 1 for the reception and relative vertical movement of a leg 2. Tubes 3 interconnect in known manner the corners 4 of the leg. A double rack 5 is provided, the plane of whose teeth is parallel to the swinging axis 6 of the leg. Double racks 7 and 8 are provided in the other corners of the leg, the plane of whose teeth is non-parallel to axis 6. Upper guides 9 and 10 are provided, against which the ends of the double rack teeth bear. These guides are connected to the platform by superstructure 11.

There is considerable play between the corners 4 of the leg and beams 12 which are part of the superstructure 11. On the other hand, there is very little play between the ends of the rack teeth and the guides 9 and 10 for the upper portion and guides 13, 14 for the lower portion.

Figure 2:
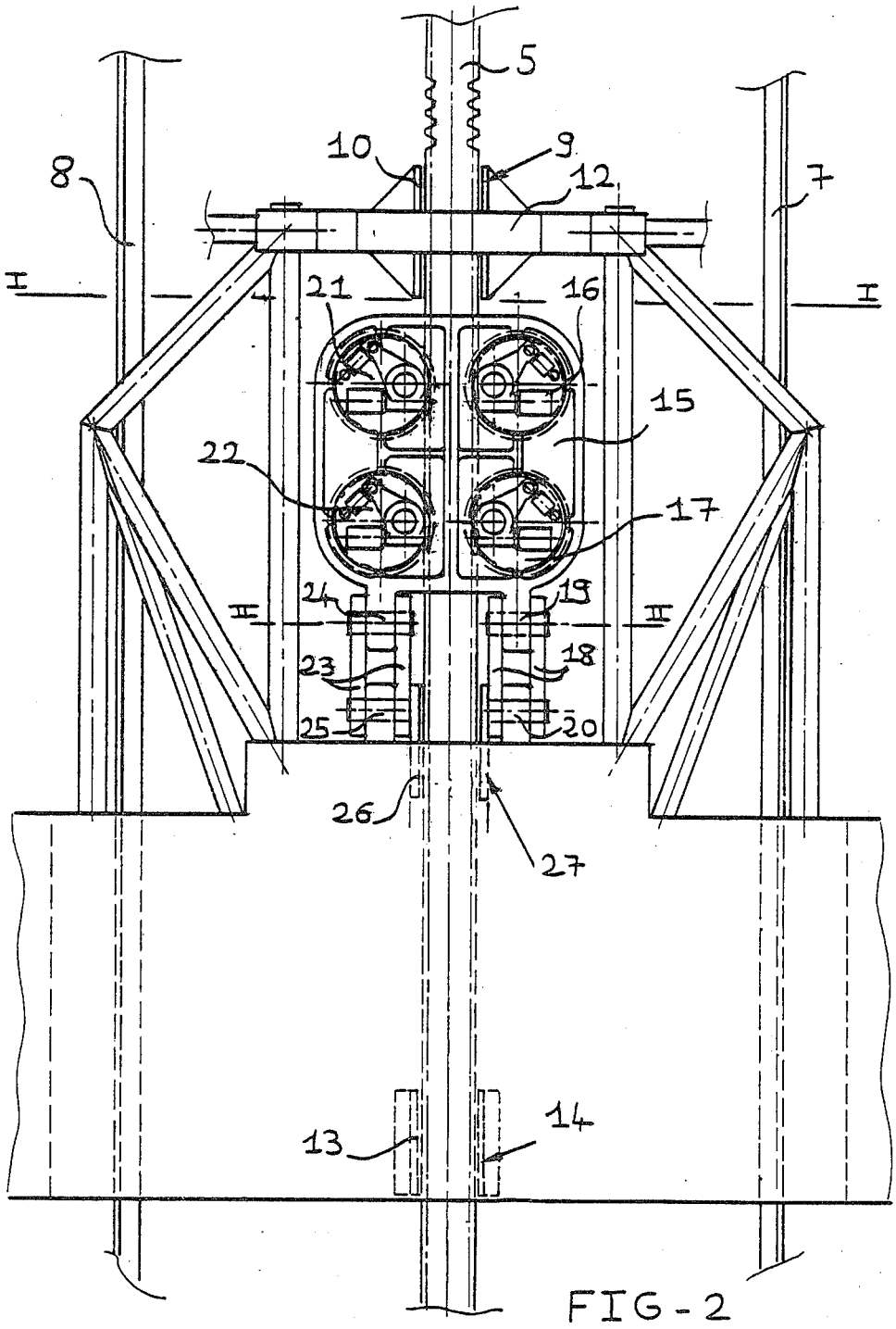
FIG. 2 is a front view of the pinion carrier which serves also for the swinging of the leg, the upper and lower guides as well as the guides at the level of the articulated links being shown in simplified form, the connecting tubes between the corners of the leg as well as the two other pinion carriers of the leg being omitted.

A pinion carrier 15, best seen in FIG. 2, includes planetary reducers 16 and 17 which drive the row of pinions. Carrier 15 is connected to the platform by links 18 which form a linkage articulated at the levels of the axles 19 and 20. Planetary reducers 21 and 22 drive the row of pinions which is connected to the platform by links 23 which form an articulated linkage at the levels of the axles 24 and 25. The axles 19, 20, 24 and 25 are substantially located in the medial plane of the teeth of the pinions and racks, which distributes the forces over the entire width of the teeth that are in contact with each other.

The racks 5, 7 and 8 are comparable to strips of constant width, and are therefore easy to guide in guides 9, 10, 13 and 14. These strips, however, can have substantial undulation due to the variations of length of the tubes 3. The distance between the two racks of a double rack is less than one meter; while the distance between the two corners of the platform is greater than 10 meters. The links 18 and 23 with their axles 19, 20, 24 and 25 permit the pinion carriers 15 on the one hand to follow without substantial impairment of their engagement, all the undulations of the strips formed by the double racks, and on the other hand to cause the leg to swing toward the center of the platform under the influence of one of the pinion carriers.

Figure 3:
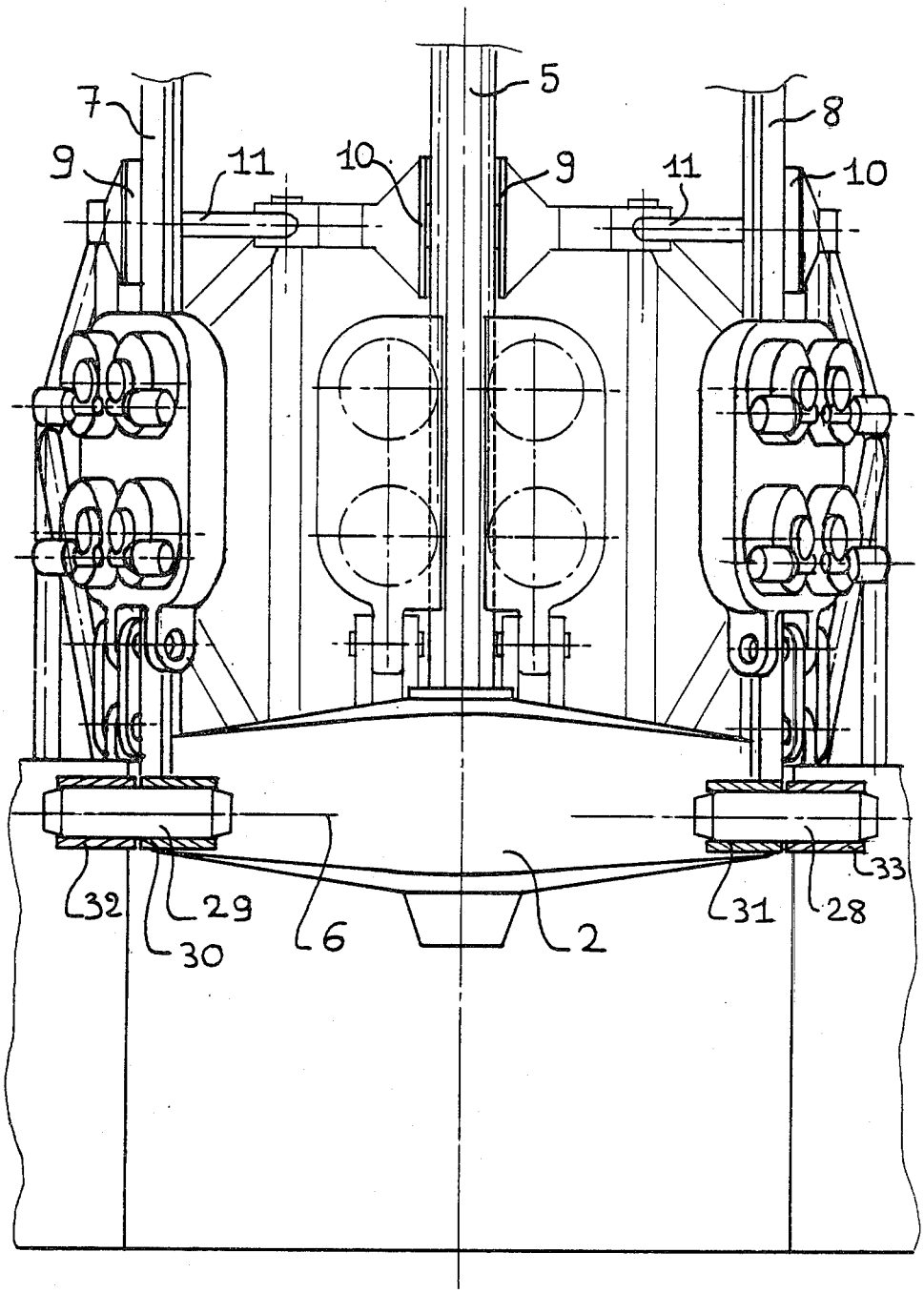
FIG. 3 is a view through the swinging axis on the line III—III; and in the direction of the arrow III in FIG. 1.

Guide blocks 26 and 27 are provided, which bear partially on links 18 and 23, these guide blocks serving when the leg 2 is raised above the guides 13 and 14 to achieve the position shown in FIG. 3, in which position the axles 28 and 29 are received in the sockets 30, 31 integral with the leg 2 and sockets 32 and 33 integral with the platform. These axles 28 and 29 define the axis 6 about which the leg swings.

Figure 4:
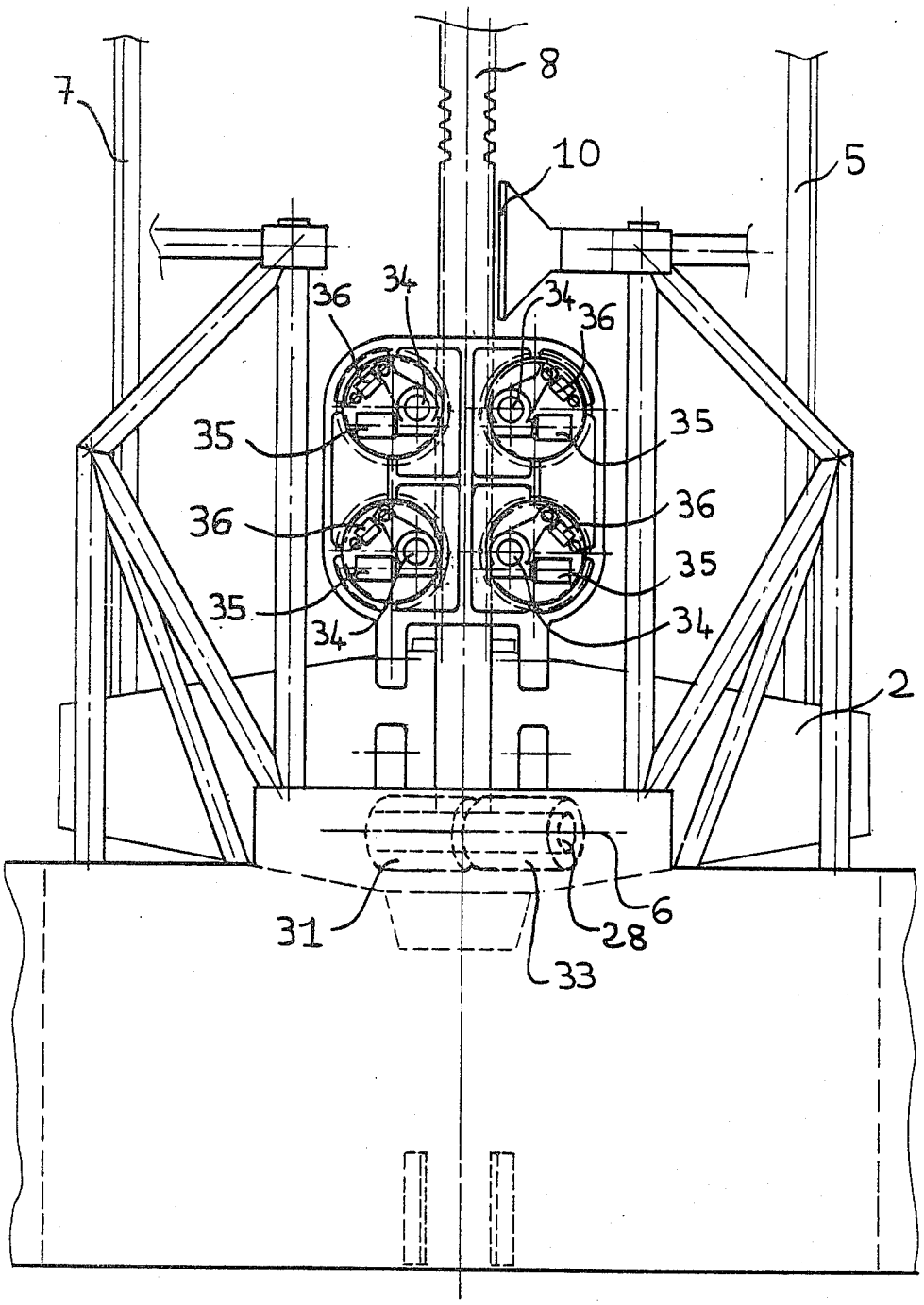
FIG. 4 is a front view of a corner of the leg with the swinging axles connected and the links and the guides disconnected just prior to swinging of the leg, with the same simplified showing as in the FIGS. 2 and 3.
Figure 5:
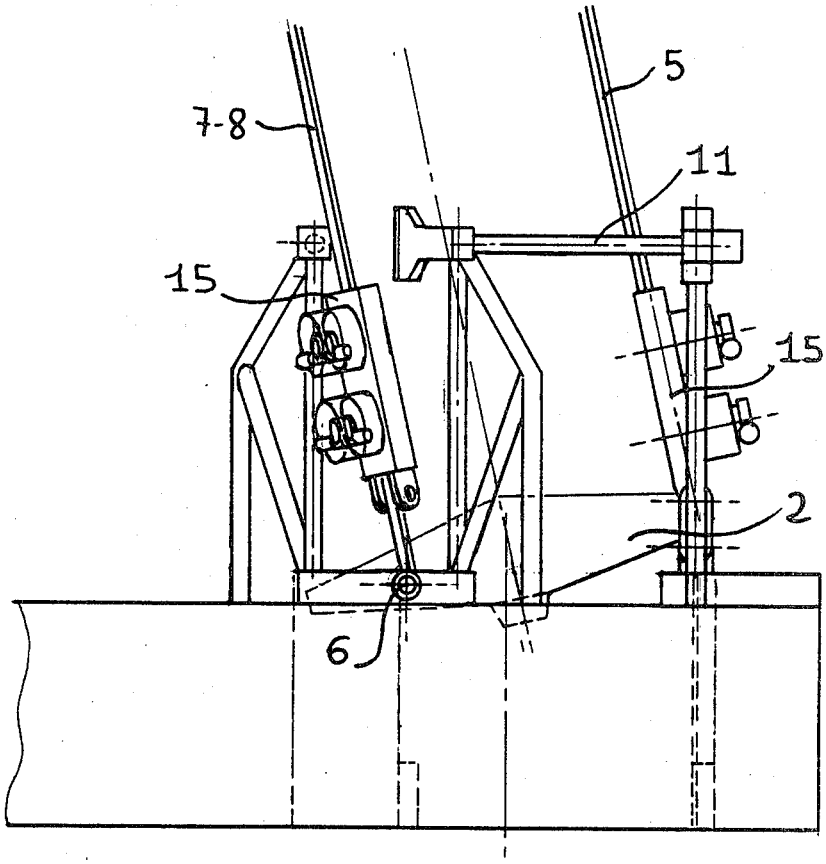
FIG. 5 is a view of the same structure with the leg swung.

Turning now to FIG. 4, the primary endless screw reducers 34 are shown, on which the brake motors 35 are supported. These motor reducers 34, 35 are of the hollow shaft type and their reverse couples are exerted by means of a reaction arm on dynamometric shock absorbers 36. These dynamometric shock absorbers permit the constant measurement of the couple acting on each pinion. Thus the motors or the brakes may be controlled accordingly, either manually or automatically.

The links 18 and 23 being disassembled for the pinion carriers 15 corresponding to the double racks 7 and 8, the guide 10 of the rack 7 and the guide 9 of the rack 8 being also disassembled, it is easily seen that the leg may be swung about the axis 6 with the aid of the pinion carrier 15 of the rack 5. If it is desired to increase the resiliency of the shock absorbers 36, which resiliency is proportional to the drive reduction, it is possible to have the axles 19 and 24 not directly in the pinion carriers 15, but in an intermediate member which is connected to the pinion carrier 15 by bolts with interposed Belleville washers or any other type of similar elastic member.

From a consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a platform having legs vertically movable relative to the platform, each leg having a double rack thereon and two rows of pinions one engageable with each rack of one of the legs; the improvement comprising a pinion carrier for each row of pinions, a link for each pinion carrier, each link being pivotally connected at one end to the platform and at the other end to its associated said pinion carrier, the links being located substantially in the medial plane of the teeth of the racks and pinions, and means detachably interconnecting the lower ends of the legs for vertically swinging movement about horizontal axes relative to the platform in raised positions of the legs, said axis being parallel to but spaced from the plane defined by the teeth of said double rack, whereby rotation of the corresponding pinions swings the leg vertically about said axis.

2. In a platform having legs vertically movable relative to the platform, each leg having a double rack thereon and two rows of pinions one engageable with each rack of one of the legs; the improvement comprising a pinion carrier for each row of pinions, a link for each pinion carrier, each link being pivotally connected at one end to the platform and at the other end to its associated said pinion carrier, the links being located substantially in the medial plane of the teeth of the racks and pinions, a planetary reducer for driving each said pinion, a motor reducer for driving each planetary reducer, said motor reducer being swingably mounted on a said pinion carrier, and a dynamometric shock absorber disposed between each motor reducer and the associated pinion carrier.

* * * * *